US011536105B2

(12) United States Patent
Al Ahmari et al.

(10) Patent No.: US 11,536,105 B2
(45) Date of Patent: Dec. 27, 2022

(54) REMOVAL OF DOWNHOLE FERROMAGNETIC DISK

(71) Applicant: Saudi Arabian Oil Company, Dhahran (SA)

(72) Inventors: Abdulrahman Al Ahmari, Juaymah (SA); Mohammed Al Dabbous, Qatif (SA)

(73) Assignee: SAUDI ARABIAN OIL COMPANY

( * ) Notice: Subject to any disclaimer, the term of this patent is extended or adjusted under 35 U.S.C. 154(b) by 61 days.

(21) Appl. No.: 17/141,417

(22) Filed: Jan. 5, 2021

(65) Prior Publication Data

US 2022/0213744 A1 Jul. 7, 2022

(51) Int. Cl.

| | |
|---|---|
| ***E21B 31/06*** | (2006.01) |
| ***E21B 33/12*** | (2006.01) |
| ***E21B 37/00*** | (2006.01) |
| *H01F 1/057* | (2006.01) |
| *H01F 1/12* | (2006.01) |

(52) U.S. Cl.

CPC ..... *E21B 31/06* (2013.01); *E21B 33/1208* (2013.01); *E21B 37/00* (2013.01); *H01F 1/057* (2013.01); *H01F 1/12* (2013.01)

(58) Field of Classification Search

CPC ..... E21B 31/06; E21B 33/1208

See application file for complete search history.

(56) References Cited

U.S. PATENT DOCUMENTS

| | | | | |
|---|---|---|---|---|
| 2,208,603 | A * | 7/1940 | Scaramucci | E21B 47/092 33/720 |
| 5,924,696 | A | 7/1999 | Frazier | |
| 6,323,307 | B1 | 11/2001 | Bigg et al. | |
| 7,661,480 | B2 | 2/2010 | Al-Anazi et al. | |
| 7,753,114 | B1 * | 7/2010 | Penisson | E21B 37/00 166/99 |
| 10,669,813 | B2 | 6/2020 | Parkins et al. | |
| 2008/0224576 | A1 * | 9/2008 | Mass | H02K 53/00 310/68 R |
| 2011/0284227 | A1 * | 11/2011 | Ayan | E21B 43/2401 73/149 |

FOREIGN PATENT DOCUMENTS

| | | | |
|---|---|---|---|
| EP | 2943643 | A1 | 11/2015 |
| WO | 2006120453 | A1 | 11/2006 |
| WO | 2014109643 | A1 | 7/2014 |

OTHER PUBLICATIONS

PCT/US2022/011158 International Search Report and Written Opinion dated Mar. 3, 2022, 12 pgs.

* cited by examiner

*Primary Examiner* — Robert E Fuller
(74) *Attorney, Agent, or Firm* — Bracewell LLP; Constance Gall Rhebergen

(57) ABSTRACT

A ferromagnetic disk is removably installed in a wellbore. The disk can be installed in the wellbore during oil and gas well completion and production activities to maintain pressure within the wellbore and then can be dislodged. More specifically, a strong magnet is installed within a magnetic tool to dislodge and remove a ferromagnetic disk without breaking the disk. The strong magnet can be a neodymium magnet, electromagnet, or other types of strong magnets.

19 Claims, 2 Drawing Sheets

REMOVAL OF DOWNHOLE FERROMAGNETIC DISK

FIELD

This disclosure relates to systems and methods for downhole tool removal. More specifically, this disclosure relates to removing a ferromagnetic disk installed in a wellbore.

BACKGROUND

During hydrocarbon well drilling and completion activities, production casing and production tubing is installed in a wellbore. Prior to production packer installation, disks—often ceramic disks—are installed within the wellbore to maintain pressure and isolate the production tubing for wellbore operations. Once production packers are installed in the production casing, the disk is broken so that well flowback operations can begin. Ceramic disks are a substantial expense.

Ceramic disks are generally ruptured with milling tools directed downhole with coiled tubing. Milling tools are drill-like tools that mechanically destroy the disk, so that the disk cannot be reused. Ceramic disks can also be broken by go-devils or dropping tools down the wellbore. The conventional method of milling or breaking the ceramic disks results in the use of heavy equipment, takes substantial time and energy, and results in debris formation in the wellbore. The conventional method of milling or breaking the ceramic disks can also result in complications related to coil tubing or debris getting locked-up (or stuck) within a wellbore, or breakage of heavy equipment. Additionally, it can take substantial time and energy to lower tools downhole, and other downhole operations may not be able to be performed downhole when the milling or tool drop is being performed, or when the tools are lowered downhole. Due to the long tool transit time downhole and due to the risk of damage or lock-up from lowering and raising downhole tools through the wellbore, performing more than one task with the same tools or during a tool run is advantageous. Therefore, additional methods of removing disks installed downhole are desired, including methods performing multiple tasks with the same apparatus.

SUMMARY

Disclosed herein are methods and systems for removing downhole, ferromagnetic disks from wellbores. The ferromagnetic disks can be installed in a wellbore during wellbore operations.

The wellbore operations can include packer installation, wellbore isolation sub installation, logging operations, or other well completion or production activities. The ferromagnetic disks include a core containing iron and a coating containing a protective coating. The ferromagnetic disks can be installed in wellbore nipples, landing nipples, sealing sections of wellbore production piping, wellbore subs, or other sections of the production piping or casing of the wellbore. The ferromagnetic disks can be installed using conventional tools including wireline and slickline tools.

More specifically, the disclosure relates to lowering a magnetic tool containing an industrial strength, strong magnet down a wellbore. The strong magnet in the magnetic tool removably attaches to the ferromagnetic disk, and when force is applied, the ferromagnetic disk can be dislodged from the wellbore casing or the wellbore tubing.

Therefore, disclosed is a method of dislodging a ferromagnetic disk removably installed in a wellbore having a wellbore environment. The method includes the step of lowering a magnetic tool down a wellbore. The magnetic tool includes a strong magnet operable to removably attach to the ferromagnetic disk with a magnetic force. The method also includes the step of attaching the strong magnet to the ferromagnetic disk with the magnetic force. The ferromagnetic disk includes a core and a coating, where the core includes iron and the coating include a protective coating shielding the core from exposure to the wellbore environment. The ferromagnetic disk is operable to maintain a desired wellbore pressure within the wellbore during a wellbore operation. The method also includes the step of applying a force through the magnetic tool containing the strong magnet, so that the force in combination with a wellbore pressure is operable to dislodge the ferromagnetic disk without breakage, where the ferromagnetic disk is removably attached to the strong magnet, so that the desired wellbore pressure is no longer maintained by the ferromagnetic disk and the ferromagnetic disk is recoverable from the wellbore in an unruptured state.

In some embodiments, the method also includes the step of removing the ferromagnetic disk from the wellbore with the magnetic tool. The ferromagnetic disk is reusable in a plurality of wellbores. In some embodiments, the strong magnet is a neodymium magnet. The neodymium magnet has a maximum energy product greater than 35 mega gauss oersteds. In other embodiments, the strong magnet is an electromagnet.

In some embodiments, the method also includes the steps of removably attaching downhole debris to the magnetic tool, where the downhole debris includes a metal component attracted to the strong magnet; and removing the downhole debris from the wellbore.

In some embodiments, the strong magnet generates a magnetic field, and the method also includes the steps of measuring a magnetic field strength of the magnetic field in a receiver, generating magnetic field data, and correlating the magnetic field data to stress characteristics of the surrounding rock, so that the single run of the magnetic tool is operable to provide dual functionality of dislodging the ferromagnetic disk and collecting magnetic field data.

In some embodiments, the ferromagnetic disk is removably installed in a disk sub. In other embodiments, the ferromagnetic disk is removably installed in a nipple installed within the wellbore.

Further disclosed is a system for removing the ferromagnetic disk removably installed in the wellbore having the wellbore environment, where the system includes the ferromagnetic disk operable to maintain a wellbore pressure within the wellbore during a wellbore operation. The ferromagnetic disk includes the core and the coating, the core containing iron and the coating containing the protective coating shielding the core from exposure to the wellbore environment. The system also includes the magnetic tool containing the strong magnet. The magnetic tool is attached to a surface link. The surface link is operable to raise and lower the magnetic tool in the wellbore. The strong magnet is operable to generate a magnetic force to attract the ferromagnetic disk without breaking the ferromagnetic disk.

In some embodiments, the strong magnet is an electromagnet, and the surface link supplies electricity to activate or deactivate the electromagnet. The system can also include a receiver, and where the strong magnet generates a magnetic field, the receiver is operable to measure and interpret the magnetic field so that surrounding rock characteristic can be identified.

In some embodiments, the strong magnet is a neodymium magnet. The strong magnet has a maximum energy product greater than 35 mega gauss oersteds. In other embodiments, the strong magnet has a maximum energy product greater than 42 mega gauss oersteds.

In some embodiments, the strong magnet has a pull force greater than a difference between a resulting downhole force and a resulting disk force, where the resulting disk force is a combination of forces operable to maintain the ferromagnetic disk in the wellbore.

In some embodiments, the ferromagnetic disk is installed in a nipple installed within the wellbore. The system can also include the ferromagnetic disk with an embedded electronic sensor operable to measure a wellbore parameter.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the scope as it can admit to other equally effective embodiments.

In the accompanying Figures, similar components or features, or both, can have a similar reference label. For the purpose of the simplified schematic illustrations and descriptions of FIGS. 1A through 3, the numerous pumps, valves, temperature and pressure sensors, electronic controllers, and the like that can be employed and well known to those of ordinary skill in the art are not included. Further, accompanying components that are in conventional industrial operations are not depicted. However, operational components, such as those described in the present disclosure, can be added to the embodiments described in this disclosure.

DETAILED DESCRIPTION

While the disclosure will be described with several embodiments, it is understood that one of ordinary skill in the relevant art will appreciate that many examples, variations and alterations to the systems and methods described are within the scope and spirit of the disclosure. Accordingly, the embodiments of the disclosure described are set forth without any loss of generality, and without imposing limitations, on the claims.

Advantages of the present disclosure include a removal of the disk without damage, so that the ferromagnetic disk can be reused in other wellbores. The use of heavy downhole milling tools that can get stuck is avoided, as is the generation of downhole debris. Additionally, in some embodiments, the magnetic tool does not require electricity or power downhole. In some embodiments, the magnetic tool has a dual functionality as it is fitted with the receiver, allowing for information to be gathered regarding the composition of the surrounding rock formations, including measuring for authogenic rock formations. In some embodiments, the ferromagnetic disk is embedded with the electronic sensors, which can measure and store information on the wellbore parameters. The ferromagnetic disk is removed intact, so that the disk can be reused in other wellbores, providing cost savings.

Figure 1B:
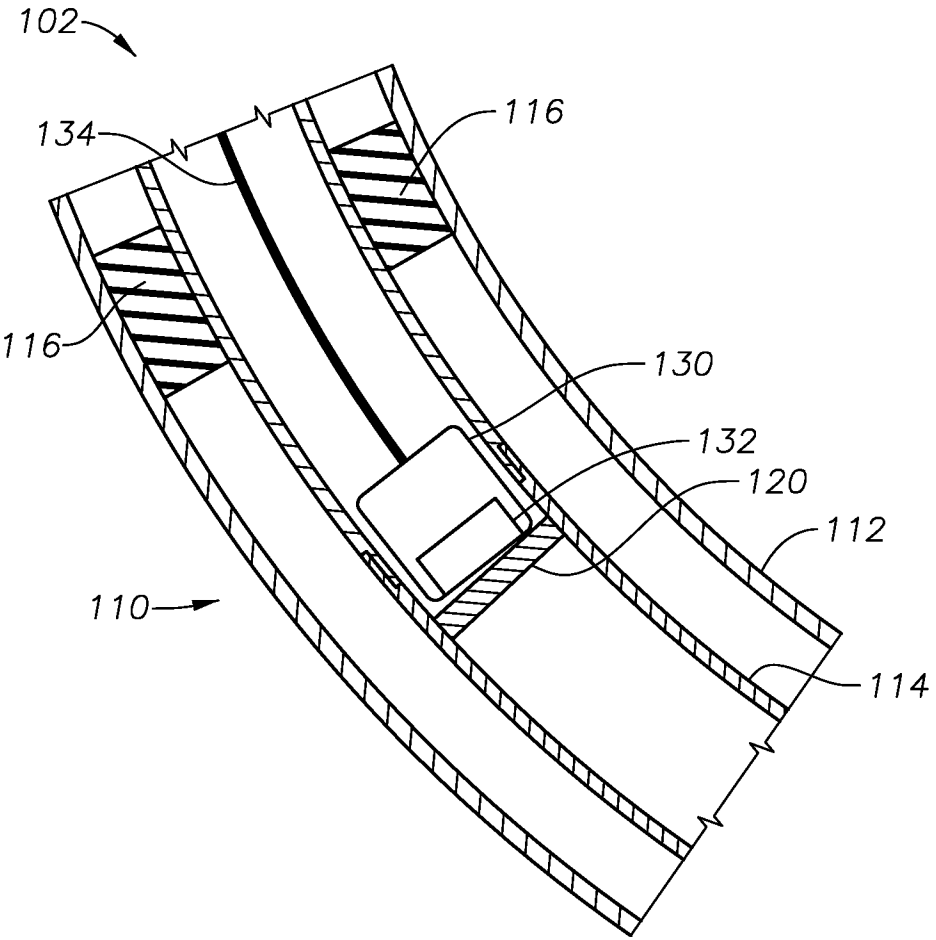
FIG. 1B is a schematic of a horizontal wellbore ferromagnetic disk removal system, according to an embodiment.
Figure 1A:
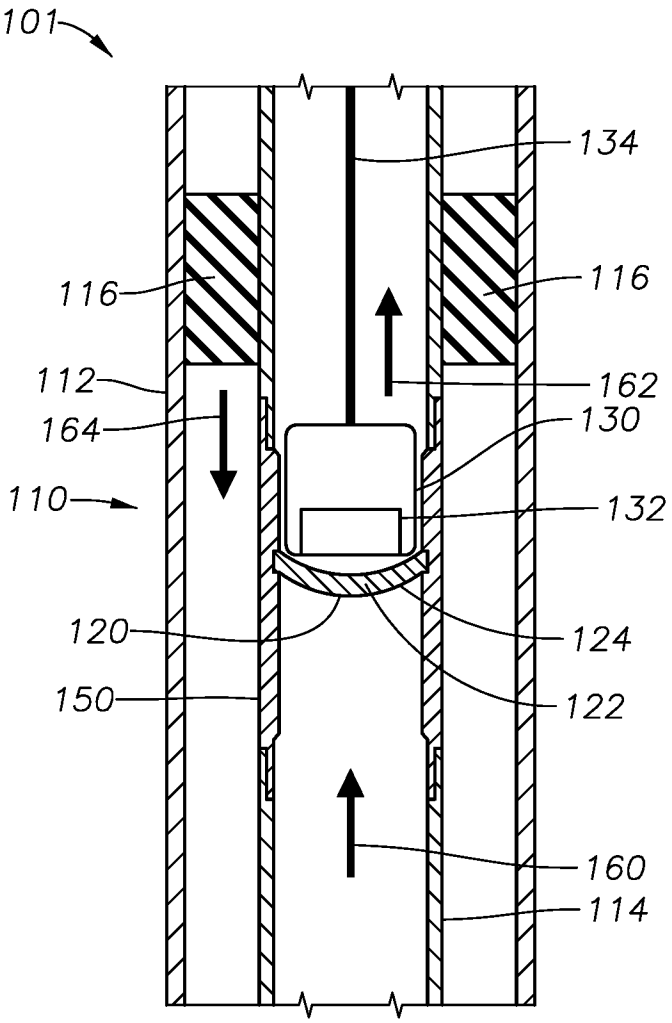
FIG. 1A is a schematic of a vertical wellbore ferromagnetic disk removal system, according to an embodiment.

Referring to FIG. 1A, vertical wellbore ferromagnetic disk removal system 101 is depicted. Wellbore 110 includes production casing 112 and production tubing 114. Installed in the annulus between production casing 112 and production tubing 114 are packers 116. Disk sub 150 is installed within production tubing 114. In some embodiments, production tubing 114 is partially made of fiberglass. Disk sub 150 is an optional component. Disk sub 150 can be a component of a drillstring, or a type portion of piping in which a disk is installed either pre-production piping installation or post-production piping installation. Installed within disk sub 150 is ferromagnetic disk 120. Ferromagnetic disk 120 can be installed using conventional tools including wireline and slickline tools. Once ferromagnetic disk 120 is installed, ferromagnetic disk 120 creates a barrier that can maintain pressure in wellbore 110. Ferromagnetic disk 120 can be installed to maintain or hold pressure in wellbore 110 during a wellbore operation. The wellbore operation can include the installation of packers 116. Ferromagnetic disk 120 can withstand and maintain wellbore pressures from 10 psi to 10,000 psi, and wellbore temperatures from 50° F. to 250° F.

Ferromagnetic disk 120 contains core 122 and coating 124. Core 122 contains an iron component, so that ferromagnetic disk 120 attracts magnets. In some embodiment, core 122 contains at least 60% iron, alternately at least 70% iron, alternately at least 80% iron, and alternately at least 90% iron. Coating 124 is a protective coating encompassing core 122 so that core 122 is not exposed to the wellbore environment, including corrosive wellbore components. Coating 124 can be any type of protective coating such as polymer or rubber. In some embodiments, ferromagnetic disk 120 includes electronic sensors in core 122 or coating 124, which can monitor information on the wellbore environment, such as pressure and temperature, and store the information in micro-memory. Ferromagnetic disk 120 can be any type of disk capable of maintaining pressure in production tubing 114 while the wellbore operation is being performed. Ferromagnetic disk 120 is a semispheric shape. Ferromagnetic disk 120 can be a flat, plate-like disk wedged within production tubing 114 or otherwise installed within production tubing 114. Ferromagnetic disk 120 can be any shape or size. In some embodiments, ferromagnetic disk 120 is a convex/concave shape, where the convex side faces the higher of the pressures within the wellbore. Ferromagnetic disk 120 can be installed by methods known in the art. Ferromagnetic disk 120 can be reusable in different wellbores.

Magnetic tool 130 is deployed by lowering into production tubing 114. Magnetic tool 130 contains strong magnet 132 and is attached to surface link 134. Surface link 134 can be coiled tubing, slick line, wire line, cable, string, tool line, any type of physical connection from magnetic tool 130 to the surface (not shown), or any combination of the same. Strong magnet 132 can be any type strong magnet available. Strong magnet 132 can be an electromagnetic, a neodymium magnet, or any other type of strong, industrial magnet. In some embodiments, strong magnet 132 has a maximum energy product of 35 mega gauss oersteds or greater. In some embodiments, strong magnet 132 has a maximum energy product of about 42 mega gauss oersteds or greater. In some embodiments, strong magnet 132 has a maximum energy product of about 52 mega gauss oersteds or greater. Strong magnet 132 generates a magnetic field and a magnetic force that attracts iron-containing objects. In embodiments where strong magnet 132 is an electromagnetic, surface link 134 contains power lines to transfer power to the electromagnet.

The lowering of magnetic tool 130 can be performed by method known in the art, such as coiled tubing, slick line, wire line, or tractors. Surface link 134 can be used to lower magnetic tool 130. Magnetic tool 130 is lowered into wellbore 110 towards ferromagnetic disk 120. The exact depth of ferromagnetic disk 120 in wellbore 110 or the exact depth magnetic tool 130 is lowered in wellbore 110 can be determined by methods known in the art, such as case coil lock. Magnetic tool 130 is lowered into wellbore 110 either making contact with ferromagnetic disk 120 so that magnetic tool 130 removably attaches to ferromagnetic disk 120. In some embodiments, magnetic tool 130 is in close proximity to making contact with ferromagnetic disk 120 so that the distance between magnetic tool 130 and ferromagnetic disk 120 is less than about 6 inches, alternately less than about 3 inches, alternately less than about 1 inch.

Magnetic tool 130 removably attaches to ferromagnetic disk 120 and as magnetic tool 130 is raised, strong magnet 132 generates pull force 162. Pull force 162 is the amount of force applied through magnetic tool 130 and surface link 134 to generate enough upward force, along with resulting downhole force 160, to overcome resulting disk force 164 which is holding ferromagnetic disk 120 in place so that ferromagnetic disk 120 can be dislodged from disk sub 150. Resulting downhole force 160 can result from the amount of force generated by the wellbore fluids or wellbore pressure. Ferromagnetic disk 120 remains unbroken and in an unruptured state. The summation of pull force 162 and resulting downhole force 160 must be greater than resulting disk force 164; however, the difference between the resulting downhole force 160 and resulting disk force 164 must not exceed the breakaway force of strong magnet 132, otherwise magnetic tool 130 exerting pull force 162 will break away from ferromagnetic disk 120. Therefore, the breakaway force of strong magnet 132 must exceed pull force 162.

Magnetic tool 130 can then be pulled to the surface (not shown) through wellbore 110 with ferromagnetic disk 120 removably attached to strong magnet 132. Ferromagnetic disk 120 can be reused in a second wellbore. Ferromagnetic disk 120 can also be retested, refurbished, or both before reuse in the second wellbore.

Referring now to FIG. 1B, horizontal wellbore ferromagnetic disk removal system 102 is depicted, and shares many of the same elements and characteristics of vertical wellbore ferromagnetic disk removal system 101. In some embodiments, ferromagnetic disk 120 is installed in the vertical portion of the horizontal wellbore, or in the substantially vertical portion of the horizontal wellbore.

Figure 2:
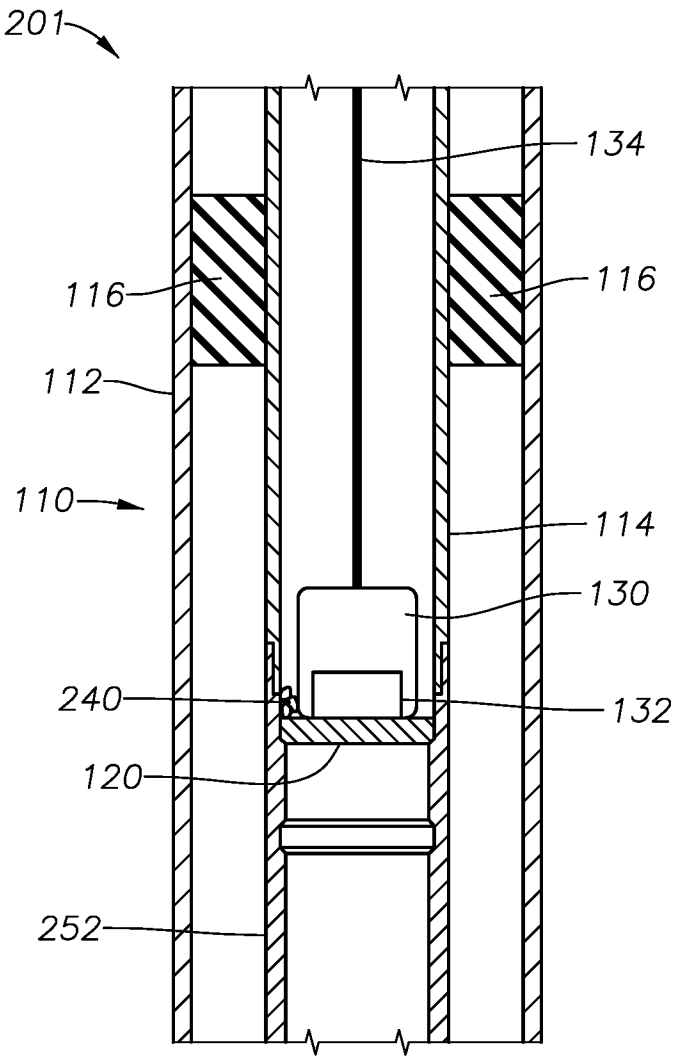
FIG. 2 is a schematic of a ferromagnetic disk and debris removal system, according to an embodiment.

Referring to FIG. 2, ferromagnetic disk and debris removal system 201 is depicted, and shares many of the same elements and characteristics of vertical wellbore ferromagnetic disk removal system 101. Advantageously, ferromagnetic disk and debris removal system 201 has a dual functionality when deployed in wellbore 110. Debris 240 is located within wellbore 110. Debris 240 includes iron containing debris, such as pieces of downhole tools, metal shavings, screws, or other objects. Debris 240 removably attaches to magnetic tool 130. As magnetic tool 130 is removed from wellbore 110, debris 240 is removed with magnetic tool 130. In some embodiments, ferromagnetic disk 120 can be removed along with debris 240.

Ferromagnetic disk 120 is installed in wellbore 110 in nipple 252. Nipple 252 is a completion component that provides a sealing area and a locking profile (not pictured). Nipple 252 is used in wellbore 110 for the installation of ferromagnetic disk 120. Nipple 252 can be a landing nipple, and can include a sealing area with a locking profile that locks ferromagnetic disk 120 in place. The locking profile can have mechanisms that hold ferromagnetic disk 120 in place during wellbore operations. The mechanisms in the locking profile can then deactivate so that ferromagnetic disk 120 is no longer locked into place in nipple 252, and can be released by magnetic tool 130. In some embodiments, nipple 252 is only a restriction and does not include a locking mechanism.

Figure 3:
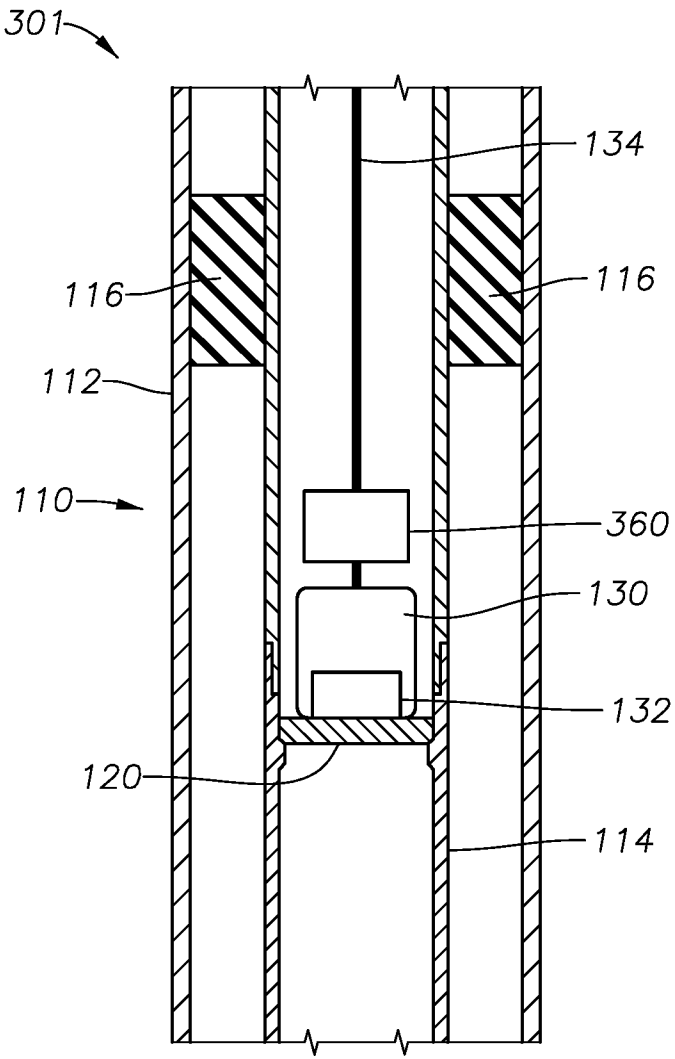
FIG. 3 is a schematic of a ferromagnetic disk removal system with receiver, according to an embodiment.

Referring to FIG. 3, ferromagnetic disk removal system with receiver 301 is depicted, and shares many of the same elements and characteristics of vertical wellbore ferromagnetic disk removal system 101. Advantageously, ferromagnetic disk removal system with receiver 301 has a dual functionality when deployed in wellbore 110. Ferromagnetic disk removal system with receiver 301 includes receiver 360 which is attached to surface link 134. Receiver 360 measures and interprets the magnetic field strength (H) of the magnetic field generated by strong magnet 132. Receiver 360 measures both the direction and magnitude of the magnetic field. Using a $\mu$ constant based on the type of fluid found in wellbore 110, the flux density (B) of the magnetic field can be calculated. The magnetic field data can then be interpreted so that information on the surrounding rock formations outside of wellbore 110 can be gathered and correlated to stress characteristics over a specific area. This information can be used for authogenic rock identification.

Although the present disclosure has been described in detail, it should be understood that various changes, substitutions, and alterations can be made without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise.

As used in the specification and in the appended claims, the words "has," and "include" and all grammatical variations thereof are each intended to have an open, non-limiting meaning that does not exclude additional elements or steps.

Ranges may be expressed throughout as from about one particular value, or to about another particular value. When such a range is expressed, it is to be understood that another embodiment is from the one particular value or to the other particular value, along with all combinations within said range.

What is claimed is:

1. A method of dislodging a ferromagnetic disk removably installed in a wellbore having a wellbore environment, the method comprising the steps of:

lowering a magnetic tool down the wellbore, the magnetic tool comprising a strong magnet operable to removably attach to the ferromagnetic disk with a magnetic force;

attaching the strong magnet to the ferromagnetic disk with the magnetic force, the ferromagnetic disk comprising a core and a coating, the core comprising iron and the coating comprising a protective coating shielding the core from exposure to the wellbore environment, the ferromagnetic disk operable to maintain a desired wellbore pressure within the wellbore during a wellbore operation; and applying a force through the magnetic tool comprising the strong magnet, such that the force in combination with a wellbore pressure is operable to dislodge the ferromagnetic disk without breakage, the ferromagnetic disk being removably attached to the strong magnet, such that the desired wellbore pressure is no longer maintained by the ferromagnetic disk and the ferromagnetic disk is recoverable from the wellbore in an unruptured state.

2. The method of claim 1, further comprising the step of removing the ferromagnetic disk from the wellbore with the magnetic tool.

3. The method of claim 1, wherein the ferromagnetic disk is reusable in a plurality of wellbores.

4. The method of claim 1, wherein the strong magnet is a neodymium magnet.

5. The method of claim 4, wherein the neodymium magnet has a maximum energy product greater than 35 mega gauss oersteds.

6. The method of claim 1, wherein the strong magnet is an electromagnet.

7. The method of claim 1, further comprising the steps of:

removably attaching downhole debris to the magnetic tool, the downhole debris comprising a metal component attracted to the strong magnet; and removing the downhole debris from the wellbore.

8. The method of claim 1, wherein the strong magnet generates a magnetic field, and further comprising the steps of:

measuring a magnetic field strength of the magnetic field in a receiver, generating magnetic field data; and correlating the magnetic field data to stress characteristics of a surrounding rock such that a single run of the magnetic tool is operable to provide dual functionality of dislodging the ferromagnetic disk and collecting the magnetic field data.

9. The method of claim 1, wherein the ferromagnetic disk is removably installed in a disk sub.

10. The method of claim 1, wherein the ferromagnetic disk is removably installed in a nipple installed within the wellbore.

11. A system for removing a ferromagnetic disk removably installed in a wellbore having a wellbore environment, the system comprising:

the ferromagnetic disk operable to maintain a desired wellbore pressure within the wellbore during a wellbore operation, the ferromagnetic disk comprising a core and a coating, the core comprising iron and the coating comprising a protective coating shielding the core from exposure to the wellbore environment;

a magnetic tool comprising a strong magnet, the magnetic tool attached to a surface link, wherein the strong magnet is operable to generate a magnetic force to attract the ferromagnetic disk without breaking the ferromagnetic disk; and the surface link operable to raise and lower the magnetic tool in the wellbore, the surface link further operable to apply a force through the magnetic tool such that the force in combination with a wellbore pressure is operable to dislodge the ferromagnetic disk without breaking the ferromagnetic disk such that the desired wellbore pressure is no longer maintained by the ferromagnetic disk.

12. The system of claim 11, wherein the strong magnet is an electromagnet, and further wherein the surface link supplies electricity to activate or deactivate the electromagnet.

13. The system of claim 11, wherein the strong magnet generates a magnetic field, and further comprising a receiver operable to measure and interpret the magnetic field such that surrounding rock characteristics can be identified.

14. The system of claim 11, wherein the strong magnet is a neodymium magnet.

15. The system of claim 14, wherein the neodymium magnet has a maximum energy product of 42 mega gauss oersteds.

16. The system of claim 11, wherein the strong magnet has a maximum energy product greater than 35 mega gauss oersteds.

17. The system of claim 11, wherein the strong magnet has a pull force greater than a difference between a resulting downhole force and a resulting disk force, the resulting disk force a combination of forces operable to maintain the ferromagnetic disk in the wellbore.

18. The system of claim 11, wherein the ferromagnetic disk is installed in a nipple in the wellbore.

19. The system of claim 11, wherein the ferromagnetic disk comprises an embedded electronic sensor operable to measure a wellbore parameter.

* * * * *